United States Patent [19]

Zimmer

[11] Patent Number: 4,946,414

[45] Date of Patent: Aug. 7, 1990

[54] CHANGEABLE BOOK STRUCTURE

[76] Inventor: Kathleen M. Zimmer, 23919 Picket, Farmington, Mich. 48024

[21] Appl. No.: 415,715

[22] Filed: Oct. 2, 1989

[51] Int. Cl.[5] ..... A63H 33/08; B42F 3/00

[52] U.S. Cl. ..... 446/71; 446/110; 402/8; 281/15.1

[58] Field of Search ..... 446/71, 80, 110, 119, 446/488, 487, 490, 476; 402/8; 281/15.1, 3.1; 283/63.1; 434/382, 159

[56] References Cited

U.S. PATENT DOCUMENTS

| | | | |
|---|---|---|---|
| 535,908 | 3/1895 | Kierolf | 446/71 |
| 2,020,196 | 11/1935 | Mallgraf | 446/478 |
| 2,032,531 | 3/1936 | Eaton | 446/80 |
| 2,183,443 | 12/1939 | Bracker | 446/80 |
| 3,261,066 | 7/1966 | Chamberlin | 402/8 |
| 3,434,233 | 3/1969 | Dean et al. | 446/80 |
| 3,456,380 | 7/1969 | Cameron | 281/15.1 X |
| 4,120,100 | 10/1978 | Dugan . | |
| 4,569,664 | 2/1986 | Giampetruzzi | 446/110 |

*Primary Examiner*—Mickey Yu
*Attorney, Agent, or Firm*—Charles W. Chandler

[57] ABSTRACT

A changeable book structure in which several panels are joined side-by-side by an elastic hinge to form a book. The elastic hinge may be separated from the panels. Each of the panels has color-coded slots, and certain of the panels also have color-coded tabs receivable in the slots so that the panels may be connected together to form a self-supporting structure, such as a playhouse.

4 Claims, 2 Drawing Sheets

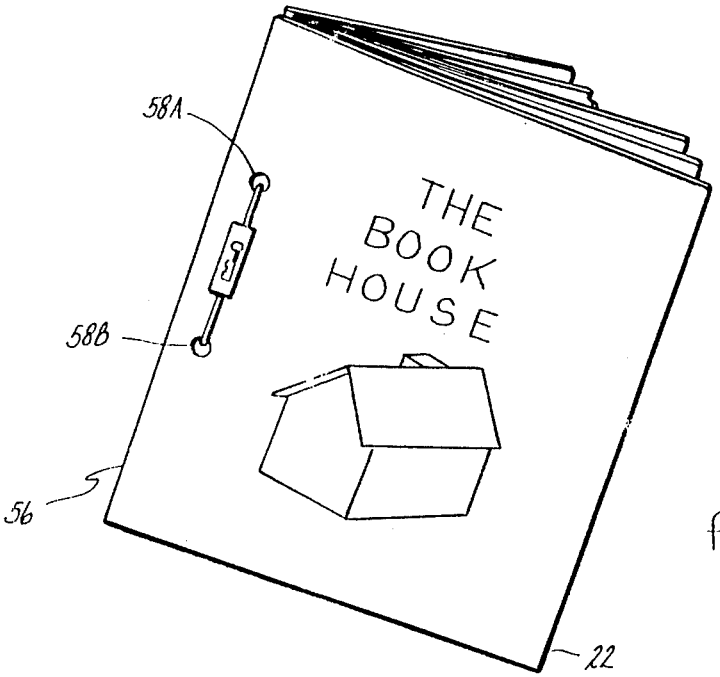
Fig. 1
Fig. 2
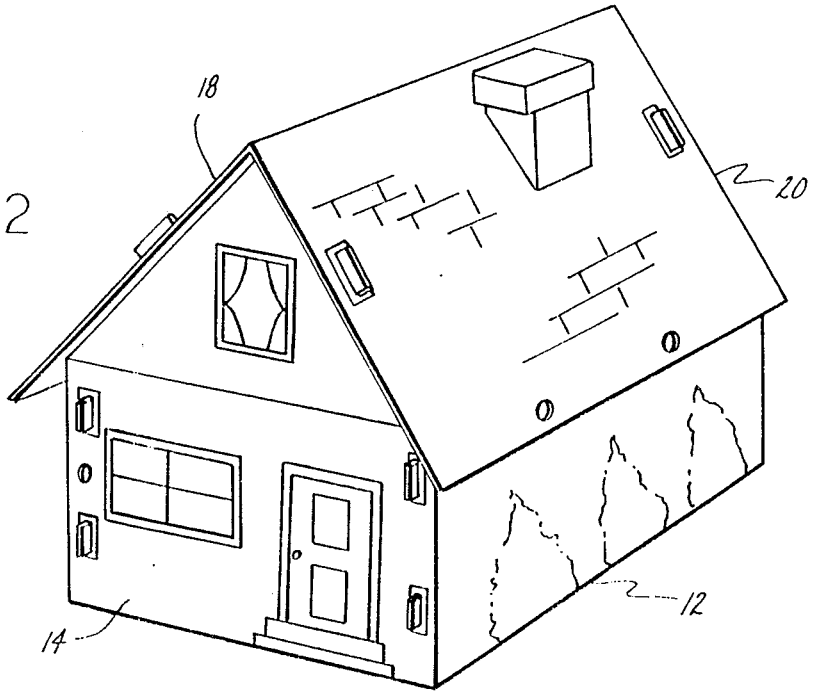

CHANGEABLE BOOK STRUCTURE

BACKGROUND OF THE INVENTION

This invention is related to a convertible or changeable book structure in which a group of panels may be assembled in one form into a book for a child, or assembled in another form into a self-supporting structure, such as a toy playhouse.

Convertible structures are known which can be assembled into play objects for children and the like. Typically such structures can be changed from one form to a totally different form by rearranging various structural components. For example, such a structure has been disclosed in U.S. Pat. No. 4,120,100 which issued Oct. 17, 1978 to Judith A. Dugan. Another structure having a series of panels connected together by tab and slot means was disclosed in U.S. Pat. No. 4,569,664, 1986 to Jerry F. Giampetruzzi and Owen C. Martin.

SUMMARY OF THE INVENTION

The broad purpose of the present invention is to provide a changeable play structure in which a series of separable panels may be joined together by an elastic hinge to form a book structure. The elastic hinge permits separation of the individual panels. When the elastic hinge is removed from the panels, the panels may be joined together by color-coded tab and slot means to form a totally different structure, such as a playhouse.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which:

FIG. 1 illustrates one form of the invention in which the panels are joined together to form a book structure;

FIG. 2 is a view illustrating the panels reassembled to form a self-supporting playhouse.

DESCRIPTION OF THE PREFERRED EMBODIMENT

Figures 3, 4:
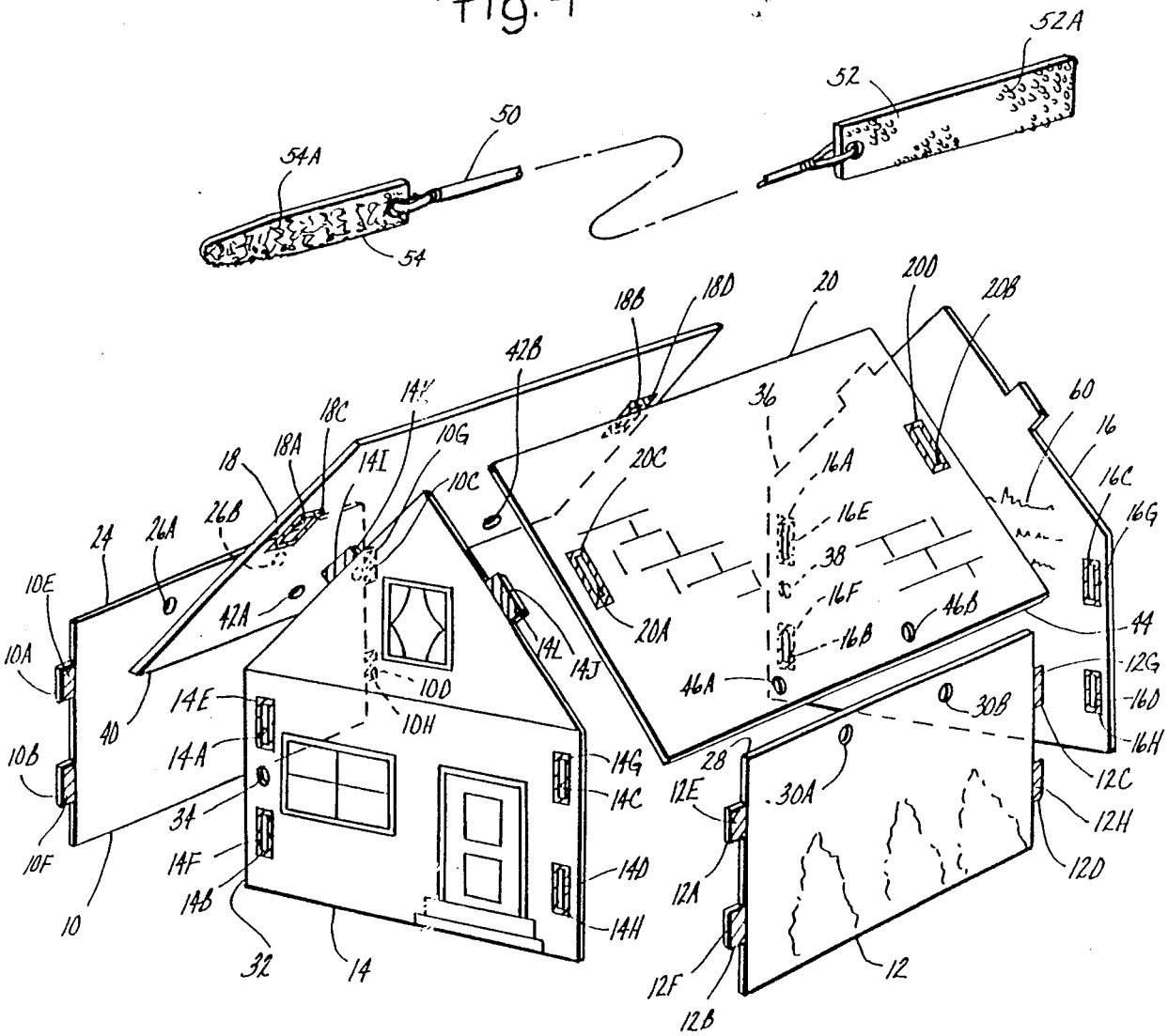
FIG. 3 is an exploded view of the panels.
FIG. 4 is a view of the elastic fastener member.

Referring to FIGS. 1 and 3, a structure illustrating the preferred embodiment of the invention preferably comprises six panels including side panels 10 and 12, a pair of end panels 14 and 16, a pair of roof panels 18 and 20 and a face panel 22.

Panel 10 has a linear side edge 24, and a pair of hinge-receiving openings 26A and 26B adjacent side edge 24.

Panel 12 has a linear side edge 28, and a pair of hinge-receiving openings 30A and 30B.

Panel 14 has a linear side edge 32, and a single hinge-receiving opening 34.

Panel 16 has a linear side edge 36, and a single hinge-receiving opening 38 adjacent edge 36.

Panel 18 has a linear side edge 40, and a pair of hinge-receiving openings 42A and 42B.

Panel 20 has a linear edge 44, and a pair of hinge-receiving openings 46A and 46B.

Referring to FIGS. 3 and 4, an elongated elastic hinge member 50 is receivable through the hinge openings of the panel members. A fabric hook-type fastener 52, such as a Velcro fastener, is attached to one end of hinge member 50. Fastener 52 is formed sufficiently narrow so that it can be inserted through the hinge-receiving openings of the panels. Fastener 52 has hook means 52A.

A second fastener 54 has a plurality of loop means 54A which cooperate with hook means 52A to form a releasable connection. Fastener 54 is elongated and sufficiently thin to be received through the hinge-receiving openings of the panels. Fastener 54 may also be a conventional fabric fastener means such as a fabric Velcro fastener.

Referring to FIG. 1, face panel 22 has a linear edge 56 and a pair of hinge-receiving openings 58A and 58B.

All the panels including face panel 22 may be assembled in a side-by-side relationship, as illustrated in FIG. 1, in which their linear side edges are adjacent one another and the hinge-receiving openings are aligned in such a manner that the elastic hinge may be threaded through openings 26A, 26B, 34, 30A, 30B, 46A, 46B, 38, 42A, 42B, 58A and 58B. Fastener pads 52A and 54A may then be releasably connected together.

The elasticity of hinge member 50 is such that the panels may be separated in the manner of a book, that is, any particular panel may be pivoted edge-to-edge about its neighboring panel so that the user can read writing, such as illustrated at 60, in FIG. 3. Each panel may have illustrations or reading material for the user.

Referring to FIG. 3, panel 18 has a pair of slots 18A and 18B. A color-coded section 18C, which for illustrative purposes is purple, is formed on the panel around slot 18A. Similarly, a purple color-coded section 18D is formed on the panel around slot 18B.

Panel 10 has a pair of tabs 10A and 10B formed along one edge, and a second pair of tabs 10C and 10D along the opposite side edge. Tabs 10A and 10B are, for illustrative purposes, color-coded orange in shaded areas 10E and 10F. Tabs 10C and 10D are color-coded yellow, in shaded areas 10G and 10H.

End panel 14 has a pair of slots 14A and 14B along one side edge, and a second pair of slots 14C and 14D along an opposite side edge. An orange color-coded section 14E is formed along slot 14A, and an orange-coded section is formed around slot 14B as shown in the shaded section 14F.

Similarly, a brown color-coded section is formed on the panel around slot 14C as illustrated in the shaded section 14G. A brown color-coded section is formed on the panel around slot 14D as illustrated in shaded section 14H.

Panel 14 also has a pair of tabs 14I and 14J. Tab 14I is color-coded blue in the shaded section 14K.

Tab 14J is color-coded green in shaded section 14L.

Panel 12 has a pair of tabs 12A and 12B along one side edge, and a pair of tabs 12C and 12D along an opposite side edge. Tabs 12A and 12B are color-coded brown in shaded sections 12E and 12F, respectively.

Tabs 12C and 12D are each color-coded black in shaded sections 12G and 12H, respectively.

Roof panel 20 has a pair of slots 20A and 20B. The panel 20 has a green color-coded section around slot 20A, at 20C. Panel 20 also has a red color-coded section around slot 20B, in shaded section 20D.

Panel 16 has a pair of slots 16A and 16B along one side edge, and a second pair of slots 16C and 16D along the opposite side edge. Panel 16 has yellow color-coded sections 16E and 16F around slots 16A and 16B, respectively. Slots 16C and 16D are color-coded black in shaded sections 16G and 16H, respectively.

Each color-coded tab of each panel is receivable in a slot of another panel having a corresponding color-coded section. For example, tabs 10A and 10B are receivable in slots 14A and 14B. Tabs 12A and 12B are receivable in slots 14C and 14D. Tabs 12C and 12D are receivable in slots 16C and 16D.

Tabs 10C and 10D are receivable in slots 16A and 16B. Tab 14K is receivable in slot 18A of roof panel 18. Tab 14J is receivable in slot 20A of roof panel 20.

Panel 16 has a pair of tabs 16I and 16J. Tab 16I is color-coded red in shaded section 16K, while tab 16J is color-coded purple as illustrated in shaded section 16L. Tab 16J is receivable in slot 18B, while tab 16J is receivable in slot 20B.

Thus, the user can readily determine where to insert each tab to form a self-supporting structure.

Preferably the panels are formed of lightweight bristol board material. Each of the slots has a width suited for receiving a corresponding tab, and a length forming a frictional engagement between the slot and the tab received in the slot.

Thus it is to be understood that I have described a series of panels that can be joined in one configuration to form a book, or another configuration into a house. It is to be understood that the panels could be adapted to be assembled into other self-supporting structures.

Having described my invention, I claim:

1. A changeable structure, comprising:

a plurality of panels:

each of said panels having a hinge-receiving opening, said hinge-receiving openings being aligned when the panels are disposed in a side-by-side assembly;

an elastic hinge member removeably mounted in said aligned hinge-receiving openings to hingedly connect the panels together to permit adjacent panels in the assembly to be moved away, one from the other, for viewing the face of the panels;

certain of said panels having at least one tab-receiving slot;

other of said panels each having a tab receivable in the slots of said certain of said panels to cooperate therewith to form a self-supporting structure, when said elastic hinge is removed from said openings in said panels; and a first of said panels having a tab-receiving slot, and a color-coded section adjacent said slot, and a second of said panels having a tab color-coded according to the color-coded section on the first of said panels to indicate that the tab is receivable in said tab-receiving slot.

2. A changeable structure as defined in claim 1, in which the plurality of panels include at least one roof section, a pair of side walls, a front wall and a back wall which may be assembled together to form a playhouse.

3. A changeable structure as defined in claim 1, in which the hinge member comprises an elongated member receivable through the hinge-receiving openings in the panels, and including cooperating fastener means on the ends of said elongated hinge member.

4. A changeable structure as defined in claim 3, in which some of said panels have a pair of openings which are aligned with openings in adjacent panels in said assembly such that the hinge member may be threaded through the hinge-receiving openings; and including fabric hook and loop fastener means mounted on the ends of said hinge member to releasably connect the ends thereof together.

* * * * *